US012486736B1

(12) United States Patent
El Mallawany et al.

(10) Patent No.: US 12,486,736 B1
(45) Date of Patent: Dec. 2, 2025

(54) BALL SCREW AND ELECTRIC BRAKE FOR A TUBING-RETRIEVABLE SAFETY VALVE

(71) Applicant: Halliburton Energy Services, Inc., Houston, TX (US)

(72) Inventors: Ibrahim El Mallawany, Al-Khobar (SA); Bruce Edward Scott, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/678,218

(22) Filed: May 30, 2024

(51) Int. Cl.
*E21B 34/10* (2006.01)

(52) U.S. Cl.
CPC ..... *E21B 34/102* (2013.01)

(58) Field of Classification Search
CPC ..... E21B 34/066; E21B 34/102; F16D 59/02
See application file for complete search history.

(56) References Cited

U.S. PATENT DOCUMENTS 3,368,657 A * 2/1968 Wrensch ..... F16D 63/002 188/161
6,041,857 A * 3/2000 Carmody ..... E21B 34/066 166/324
6,241,015 B1 * 6/2001 Pringle ..... E21B 34/066 166/320
6,253,843 B1 * 7/2001 Rawson ..... E21B 34/066 166/332.8
6,619,388 B2 * 9/2003 Dietz ..... E21B 34/066 166/66
6,988,556 B2 * 1/2006 Vick, Jr. ..... E21B 34/101 166/66.5
8,453,748 B2 * 6/2013 Vick, Jr. ..... E21B 34/10 166/321
8,464,799 B2 * 6/2013 Scott ..... E21B 34/16 166/373
9,140,101 B2 9/2015 Scott et al.
9,157,299 B2 10/2015 Vick, Jr. et al.
9,291,033 B2 * 3/2016 Scott ..... E21B 34/16
9,383,029 B2 7/2016 Scott
9,494,015 B2 11/2016 Vick, Jr. et al.
9,556,707 B2 1/2017 Vick, Jr. et al.
9,631,456 B2 4/2017 Vick, Jr. et al.
9,810,039 B2 11/2017 Vick, Jr. et al.
9,909,387 B2 3/2018 Scott et al.
9,982,510 B2 5/2018 Vick, Jr. et al.
10,480,283 B2 11/2019 Joseph et al.
(Continued)

FOREIGN PATENT DOCUMENTS

CN 115492880 A * 12/2022
JP 3992793 B2 * 10/2007
(Continued)

OTHER PUBLICATIONS

International Search Report and Written Opinion for International Patent Application No. PCT/US2024/035443 dated Feb. 24, 2025. PDF file. 8 pages.

*Primary Examiner* — Jennifer H Gay
(74) *Attorney, Agent, or Firm* — Scott Richardson; C. Tumey Law Group PLLC

(57) ABSTRACT

In general, in one aspect, embodiments relate to a sliding assembly, that includes a hydraulic piston, a ball nut affixed to the hydraulic piston, a ball screw disposed through the ball nut, and an electric brake affixed to the ball screw.

17 Claims, 8 Drawing Sheets

(56) References Cited

U.S. PATENT DOCUMENTS 10,513,908 B2 12/2019 Scott et al.
10,670,160 B2 * 6/2020 Phelps ..... E21B 34/066
11,035,199 B2 6/2021 Vick, Jr. et al.
11,131,161 B2 9/2021 Fripp et al.
11,168,540 B2 11/2021 Ng et al.
11,248,441 B2 * 2/2022 Vick, Jr. ..... E21B 34/10
11,448,040 B2 9/2022 El Mallawany et al.
11,643,905 B2 5/2023 Vick, Jr. et al.
11,668,160 B1 6/2023 Passmore et al.
11,668,161 B2 6/2023 Vick, Jr. et al.
11,851,961 B1 12/2023 Passmore et al.
11,867,263 B2 * 1/2024 Lee ..... F16H 25/2204
11,885,202 B2 1/2024 Vick, Jr. et al.
11,939,837 B2 * 3/2024 Wood ..... F16D 11/16
11,952,873 B1 4/2024 El Mallawany et al.
12,123,282 B2 * 10/2024 Passmore ..... E21B 34/00
12,158,056 B2 * 12/2024 Wood ..... E21B 34/066
2002/0108747 A1 * 8/2002 Dietz ..... E21B 34/066
166/66.4
2003/0155131 A1 * 8/2003 Vick, Jr. ..... E21B 34/10
166/332.8
2004/0173362 A1 9/2004 Waithman et al.
2007/0137869 A1 6/2007 MacDougall et al.
2009/0152057 A1 * 6/2009 Yamamoto ..... E05F 11/505
74/425
2010/0175867 A1 7/2010 Wright et al.
2011/0186303 A1 * 8/2011 Scott ..... E21B 34/08
166/373
2011/0240299 A1 * 10/2011 Vick, Jr. ..... E21B 34/10
137/511
2013/0175025 A1 7/2013 Vick, Jr. et al.
2013/0206389 A1 8/2013 Vick, Jr. et al.
2013/0248203 A1 * 9/2013 Scott ..... E21B 34/066
166/373
2014/0216867 A1 * 8/2014 Yasuda ..... F16D 55/28
188/163
2015/0123808 A1 5/2015 Vick, Jr. et al.
2015/0316170 A1 11/2015 Scott
2016/0258250 A1 9/2016 Vick, Jr. et al.
2016/0273304 A1 9/2016 Vick, Jr. et al.
2017/0002945 A1 * 1/2017 Phelps ..... E21B 34/066
2019/0331174 A1 * 10/2019 Mastrocola ..... F16D 27/14
2020/0032616 A1 * 1/2020 Vick, Jr. ..... E21B 34/10
2020/0063518 A1 2/2020 Fripp et al.
2021/0115759 A1 4/2021 Ng et al.
2023/0349262 A1 11/2023 Scott
2023/0358300 A1 * 11/2023 Lee ..... E21B 23/06
2023/0417123 A1 * 12/2023 Wood ..... E21B 34/066
2023/0417124 A1 * 12/2023 Wood ..... E21B 34/066
2023/0417125 A1 * 12/2023 Wood ..... E21B 34/066
2024/0052722 A1 * 2/2024 Passmore ..... E21B 41/00
2024/0060393 A1 2/2024 Scott et al.
2024/0117718 A1 4/2024 El Mallawany et al.
2024/0175335 A1 * 5/2024 Chouzenoux ..... E21B 34/16

FOREIGN PATENT DOCUMENTS

JP 2011174601 A * 9/2011
JP H0723845 U * 9/2011

* cited by examiner

BALL SCREW AND ELECTRIC BRAKE FOR A TUBING-RETRIEVABLE SAFETY VALVE

BACKGROUND

Safety valves are installed in wellbores to prevent uncontrolled release of reservoir fluids. Safety valves are typically hydraulically actuated and may be tubing-retrievable. These are typically "fail safe," meaning that the default unactuated configuration is in a closed position to thereby ensure that in the event of failure, the safety valve closes. Due to environmental concerns, the oil and gas industry has seen a recent shift away from using hydraulically actuated safety valves in favor of using electrically actuated safety valves.

BRIEF DESCRIPTION OF THE DRAWINGS

These drawings illustrate certain aspects of some of the embodiments of the present invention and should not be used to limit or define the invention.

DETAILED DESCRIPTION

Disclosed herein are systems and methods for regulating the flow of production fluids through wellbores and, more particularly, disclosed are safety valves having an opened and a fail-safe configuration. More particularly, disclosed are safety valves which may include a sliding assembly having an electric brake.

As mentioned, the oil and gas industry has seen a shift away from using hydraulic actuated safety valves in favor of electrically actuated safety valves. One problem associated with some electrically actuated safety valves using electromagnets to hold the valve open is that scale and debris may build up, for example, between an electromagnet and its target. Since the magnetic force of an electromagnet is inversely proportional to the square of the distance between it and its target, built-up debris or scale may significantly hamper the magnet's hold force capability.

The present disclosure may provide a hybrid configuration that involves both a hydraulic piston and an electric brake. This may have the benefit of bypassing the challenges associated with using an electromagnet and target while still allowing the safety valve to be electrically controlled. Specifically, the safety valve may have a sliding assembly that uses a hydraulic piston to open the safety valve but uses an electric brake to hold open the safety valve so that in the event of power loss, the safety valve reverts to the closed fail-safe position. Generally, hydraulic pressure is not utilized to maintain the sliding assembly and thus the safety valve in the open position.

Other advantages may include, without limitation, a reduction in the amount of hydraulic fluid needed to achieve and maintain the open position for the safety valve and thus decreased risk of leaking hydraulic fluid into the formation, greater downhole reliability than safety valves that use only an electromagnet to open and maintain the open position. Another advantage may include the ability to exhaust hydraulic control fluid after a safety valve is open when an electric brake (e.g., electric brake 412 of FIG. 4) is engaged, which in addition to reducing stress on one or more components of the safety valve, may result in a reduction in overall stress on a hydraulic control system, in general.

Figure 1:
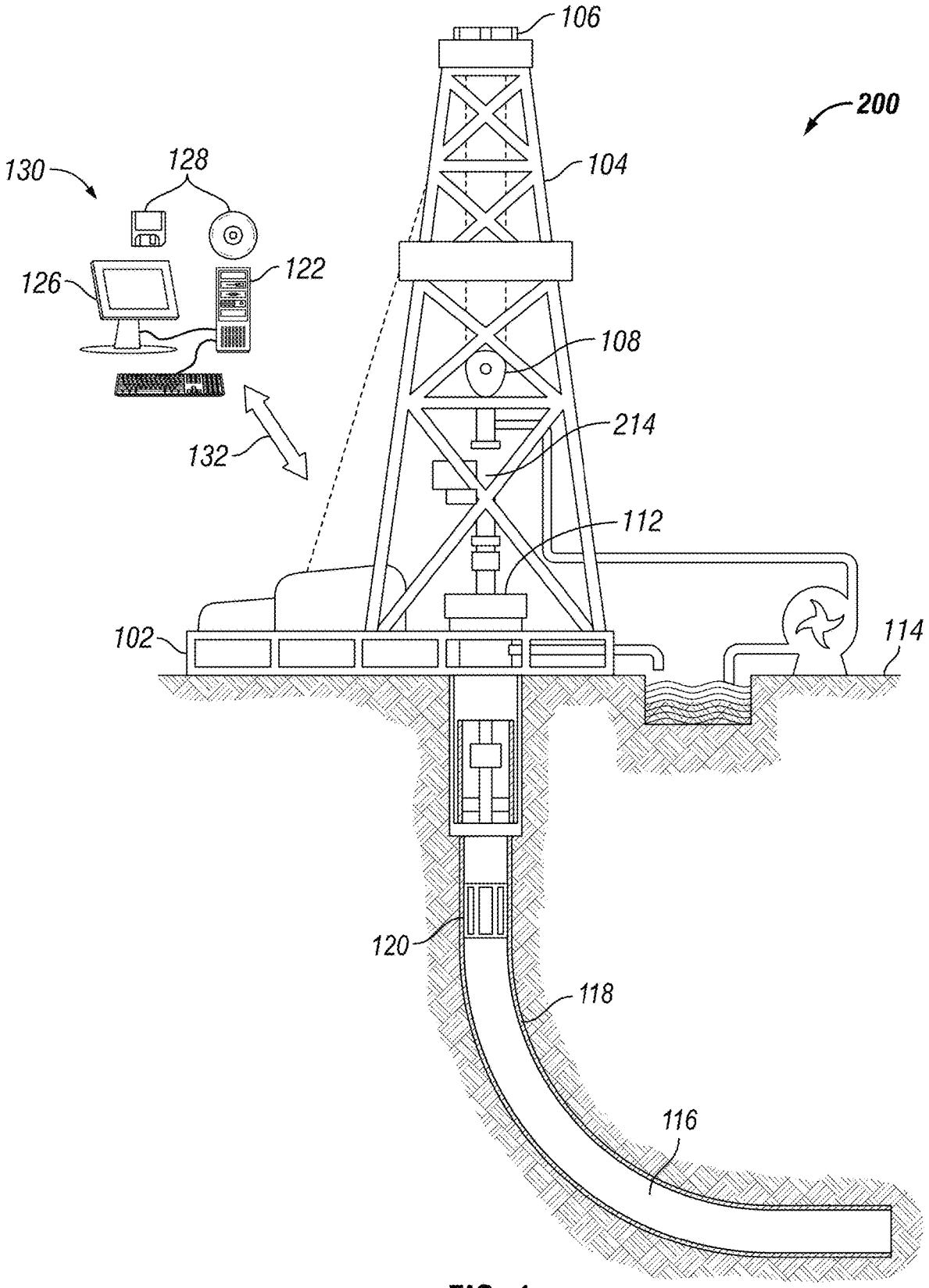
FIG. 1 is a schematic of an example wellbore environment, in accordance with some embodiments of the present disclosure.

FIG. 1 is a schematic of an example wellbore environment. Wellbore environment 100 may include platform 102 that supports derrick 104 having a traveling block 108 for raising and lowering top drive 110 and tool string. Top drive 110 supports and rotates the tool string as it is lowered through wellhead 112. In turn, drill bit 124, located at the end of tool string, may create wellbore 116. Each of these components is described below.

Platform 102 is a structure which may be used to support one or more other components of wellbore environment 100 (e.g., derrick 104). Platform 102 may be designed and constructed from suitable materials which are able to withstand the forces applied by other components (e.g., the weight and counterforces experienced by derrick 104). In any embodiment, platform 102 may be constructed to provide a uniform surface for wellbore completions operations in wellbore environment 100.

Derrick 104 is a structure which may support, contain, and/or otherwise facilitate the operation of one or more pieces of the wellbore completions equipment. In any embodiment, derrick 104 may provide support for crown block 106, traveling block 108, and/or any part connected to (and including) tool string. Derrick 104 may be constructed from any suitable materials (e.g., steel) to provide the strength necessary to support those components.

Crown block 106 is one or more simple machine(s) which may be rigidly affixed to derrick 104 and include a set of pulleys (e.g., a "block"), threaded (e.g., "reeved") with a line (e.g., a steel cable), to provide mechanical advantage. Crown block 106 may be disposed vertically above traveling block 108, where traveling block 108 is threaded with the same line.

Traveling block 108 is one or more simple machine(s) which may be movably affixed to derrick 104 and include a set of pulleys, threaded with a line, to provide mechanical advantage. Traveling block 108 may be disposed vertically below crown block 106, where crown block 106 is threaded with the same line. In any embodiment, traveling block 108 may be mechanically coupled to a tool string (e.g., via top drive 110) and allow for a tool string (and/or any component thereof) to be lifted from (and out of) wellbore 116. Both crown block 106 and traveling block 108 may use a series of parallel pulleys (e.g., in a "block and tackle" arrangement) to achieve significant mechanical advantage, allowing for the tool string to handle greater loads (compared to a configuration that uses non-parallel tension). Traveling block 108 may move vertically (e.g., up, down) within derrick 104 via the extension and retraction of the line.

Top drive 110 is a machine which may be configured to, e.g., rotate tool string. Top drive 110 may be affixed to traveling block 108 and configured to move vertically within derrick 104 (e.g., along with traveling block 108). In any embodiment, the rotation of tool string (caused by top drive 110) may allow for tool string to carve wellbore 116. Top drive 110 may use one or more motor(s) and gearing mechanism(s) to cause rotations of tool string. In any embodiment, a rotatory table (not shown) and a "Kelly" drive (not shown) may be used in addition to, or instead of, top drive 110.

Wellhead 112 is a machine which may include one or more pipes, caps, and/or valves to provide pressure control for contents within wellbore 116 (e.g., when fluidly connected to a well (not shown)). In any embodiment, during drilling, wellhead 112 may be equipped with a blowout preventer (not shown) to prevent the flow of higher-pressure fluids (in wellbore 116) from escaping to the surface in an uncontrolled manner. Wellhead 112 may be equipped with other ports and/or sensors to monitor pressures within wellbore 116 and/or otherwise facilitate drilling operations.

Wellbore 116 is a hole in the ground which may be formed by a tool string (and one or more components thereof). Wellbore 116 may be partially or fully lined with casing 118. As illustrated, a wellbore 116 may be vertical, horizontal, angled, or have any number of vertical, horizontal, or angled sections.

Casing 118 is concrete and/or metal lining that separates wellbore 116 from the surrounding ground. Casing 118 may be used to protect the surrounding ground from the contents of wellbore 116, and conversely, to protect wellbore 116 from the surrounding ground.

Safety valve 120 is a downhole device that prevents production mishaps that could occur with the producing well. There are various types of safety valves, including for example, surface-controlled subsurface safety valves, tubing-retrievable subsurface safety valves, wireline-retrievable safety valves, flapper-type wireline-retrievable safety valves, injection safety valves, flapper-type injection valves, annular safety valves, and the like.

Systems and methods of the present disclosure may be implemented, at least in part, with information handling system 130. Information handling system 130 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 130 may be a personal computer, a network storage device, or any other suitable device and may vary in size, shape, performance, functionality, and price. Information handling system 130 may include random access memory (RAM), one or more processing resources such as a central processing unit (CPU) 122 or hardware or software control logic, ROM, and/or other types of nonvolatile memory. Additional components of the information handling system 130 may include one or more disk drives, one or more network ports for communication with external devices as well as an input device (e.g., keyboard, mouse, etc.) and output devices, such as a video display 126. Information handling system 130 may also include one or more buses operable to transmit communications between the various hardware components.

Alternatively, systems and methods of the present disclosure may be implemented, at least in part, with non-transitory computer-readable media 128. Non-transitory computer-readable media 128 may include any instrumentality or aggregation of instrumentalities that may retain data and/or instructions for a period of time. Non-transitory computer-readable media 128 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

As illustrated, communication link 132 (which may be wired or wireless, for example) may be provided that may transmit data (e.g., instructions to open or close safety valve 120, sensor measurements, etc.) between wellbore environment 100 and information handling system 130. Information handling system 130 may include a central processing unit 122, a video display 126, an input device, and/or non-transitory computer-readable media 128 (e.g., optical disks, magnetic disks, etc.) that may store code representative of the methods described herein. In addition to, or in place of processing at surface 114, processing may occur downhole. However, in some examples, a safety valve (e.g., safety valve 120) may comprise simple ON-OFF devices that do not need sophisticated electronics, but may function based on, e.g., simple energizing and de-energizing of the safety valve.

Figure 2:
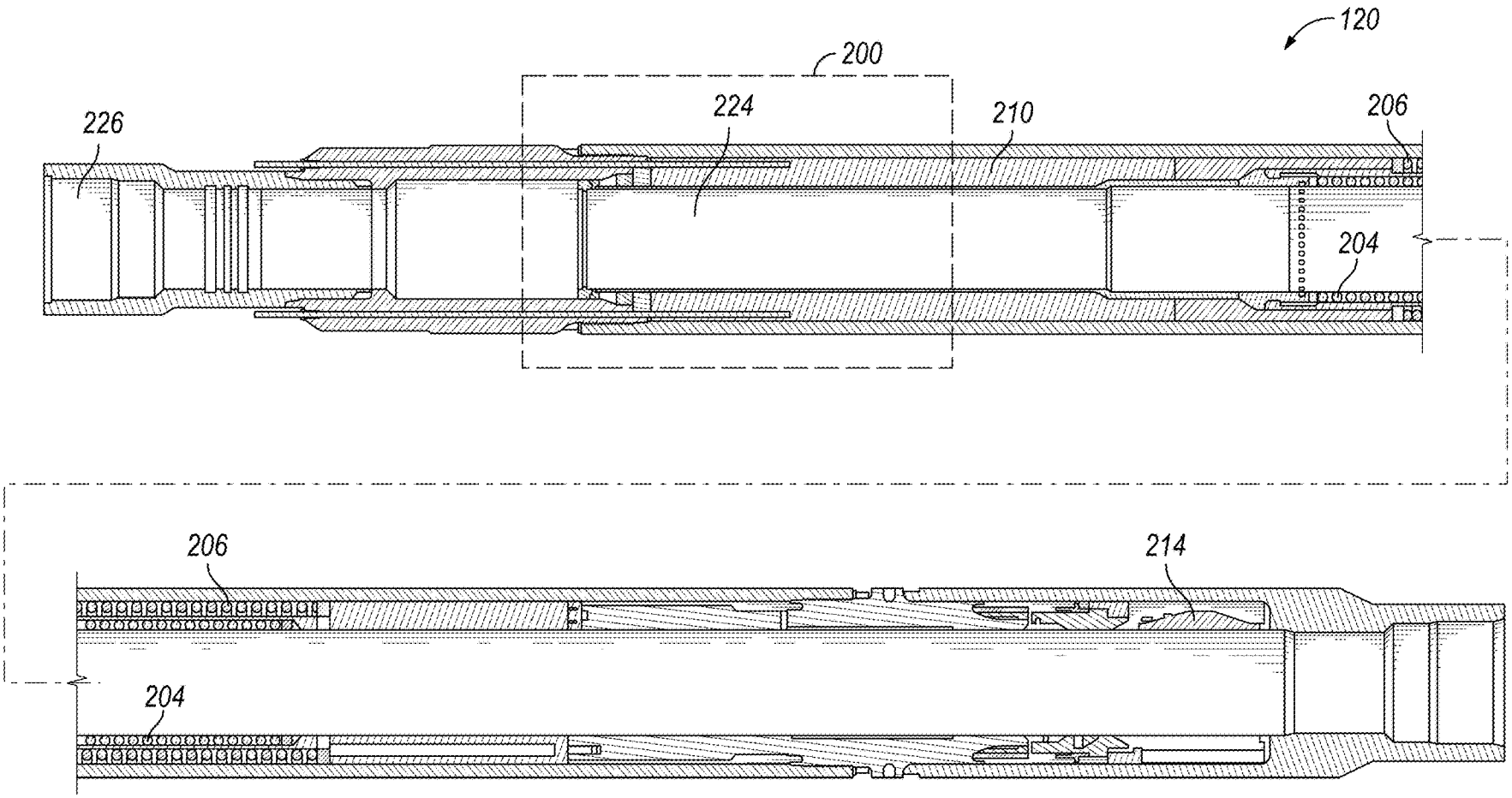
FIG. 2 is a schematic of a safety valve that includes an actuator section in an open position, in accordance with some embodiments of the present disclosure.

FIG. 2 is a schematic of a safety valve 120 that includes an actuator section 200 in an open position, in accordance with some embodiments of the present disclosure. Actuator section 200 may comprise a piston, ball nut, and ball screw, to be discussed and later figures (e.g., referring to FIGS. 4, 5A, 5B). Additionally, an actuator section 200 may comprise an electric brake (e.g., electric brake 412 of any of FIGS. 5A, 5B, 6, 7A, 7B, 8A, and 8B) that includes an electromagnet and a target, to be discussed. In examples, actuator section 200 may serve to open and close off flow across a valve 214. This figure also shows nose spring 204 and power spring 206 as well as valve 214. An electric brake (e.g., electric brake 412 of FIG. 4), or plurality thereof, may be disposed in any suitable region, such as within actuator section 200 or in the region of safety valve 120 indicated at 210, and may comprise an electromagnet and a target, to be discussed later (e.g., referring to FIGS. 7A, 7B). One or more of these may be coupled with one or more gear boxes, to be discussed later (e.g., referring to FIG. 6). Where used, an electromagnet may include a magnetized or magnetizable material such as one or more rare earth elements.

Figure 3B:
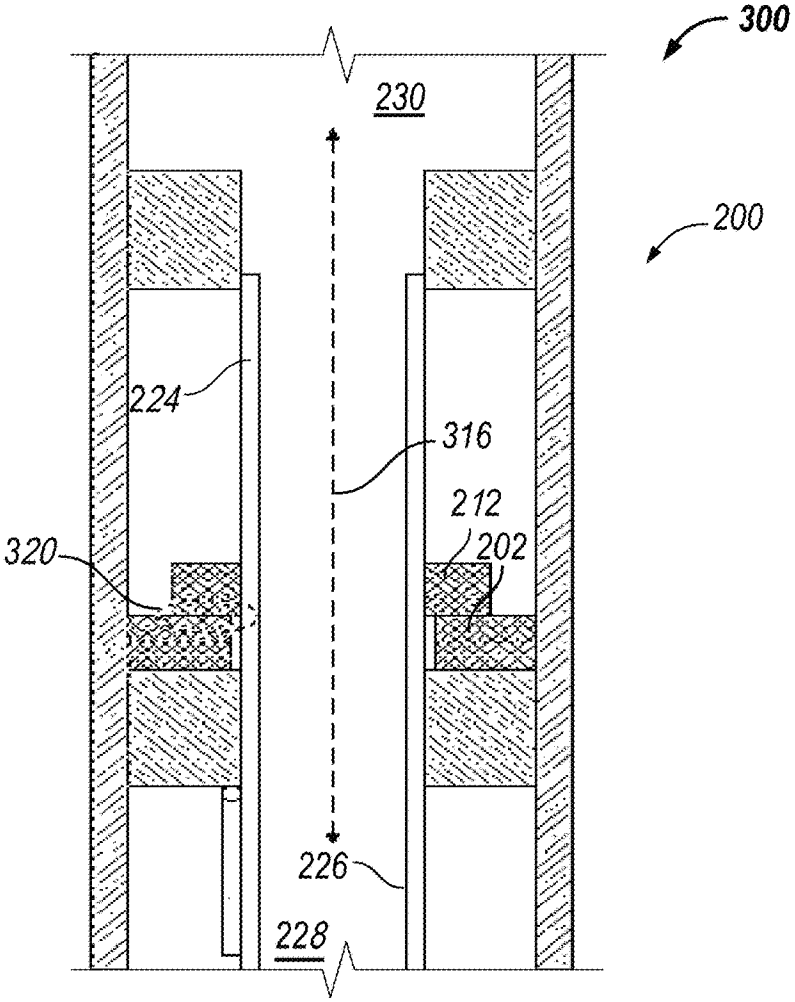
FIG. 3B is a schematic of the electromagnet structure of FIG. 3A but in an open position, in accordance with some embodiments of the present disclosure.
Figure 3A:
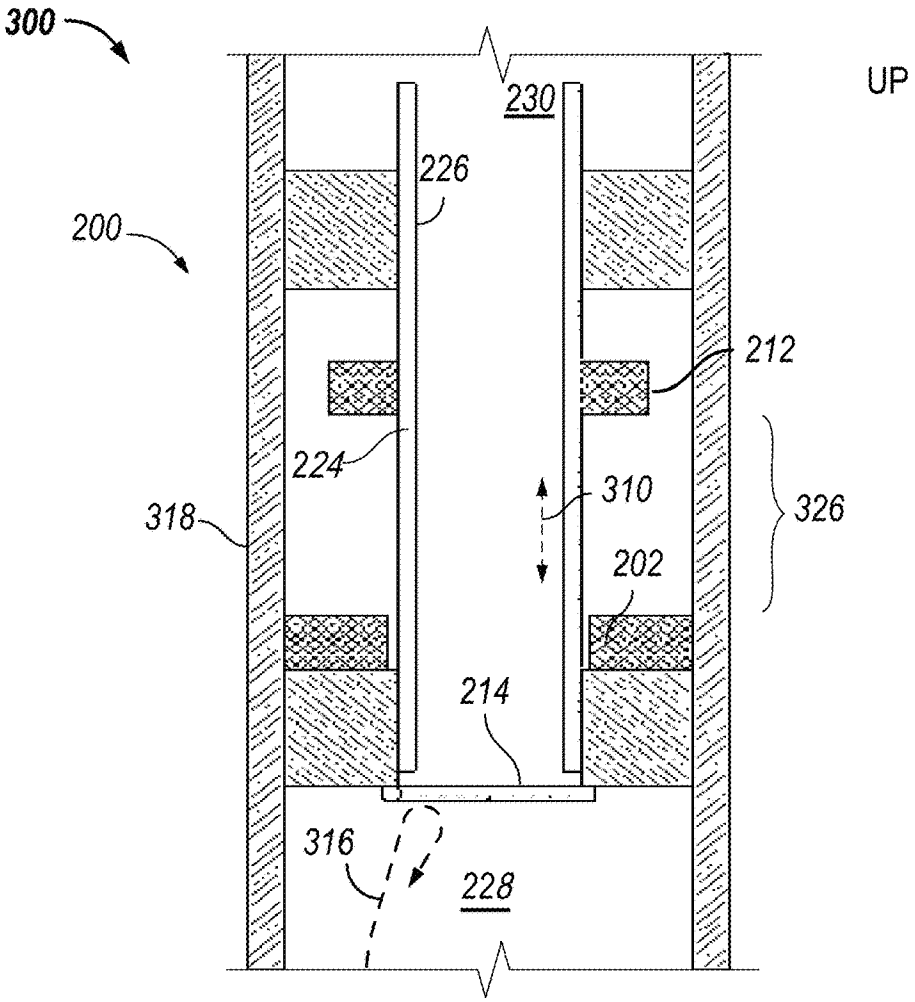
FIG. 3A is a schematic of an electromagnet structure of a safety valve in a closed position, in accordance with some embodiments of the present disclosure.

FIG. 3A is a schematic of an electromagnet structure 300 of a safety valve 120 in a closed position, in accordance with some embodiments of the present disclosure. As illustrated, an electromagnet structure 300 may comprise an electromagnet 202 which may be, for example, concentrically disposed about a slidable member 224 having a bore 226 along an axis indicated at 310. In the closed position, an upward flow of fluid 316 through bore 226 is stopped by a flapper valve 214. A target 212 may be spaced away from electromagnet 202 in the closed and unenergized position, as shown, and may thus be separated by a distance 326. Lower and upper regions 228, 230 are thus not in fluid communication in the closed position. This is but one example configuration of an electromagnetic structure 300. FIG. 3B is a schematic of the electromagnet structure 300 of FIG. 3A but in an open and energized position, in accordance with some embodiments of the present disclosure. As illustrated, in the open position, fluid 316 is free to flow through bore 226. Accordingly, fluid 316 may flow to thereby allow fluid communication between lower region 228 and upper region 230. In the open position, target 212 is attracted to electromagnet 202 when electromagnet structure 300 is powered, which thereby axially translates the slidable member 224 downward by distance 326. Other designs are possible, such as electromagnet 302 not being concentrically disposed about slidable member 224, or with the inducement of linear movement comprising using a magnetic flux to push rather than pull slidable member 224 to an open configuration, for example. As mentioned, one disadvantage of safety valves that use only an electromagnet structure 300, e.g., without hydraulic piston 404 of later figures, is that debris such as scale can build up overtime between electromagnet 202 and target 212, such as at the region schematically indicated at 320, reducing or defeating the effectiveness of the safety valve, especially ones using small magnets. Advantageously, incorporating a design that uses a hydraulic piston, ball screw, ball nut, and electric brake, in accordance with one or more embodiments of the present disclosure, addresses this and associated problems.

Figure 4:
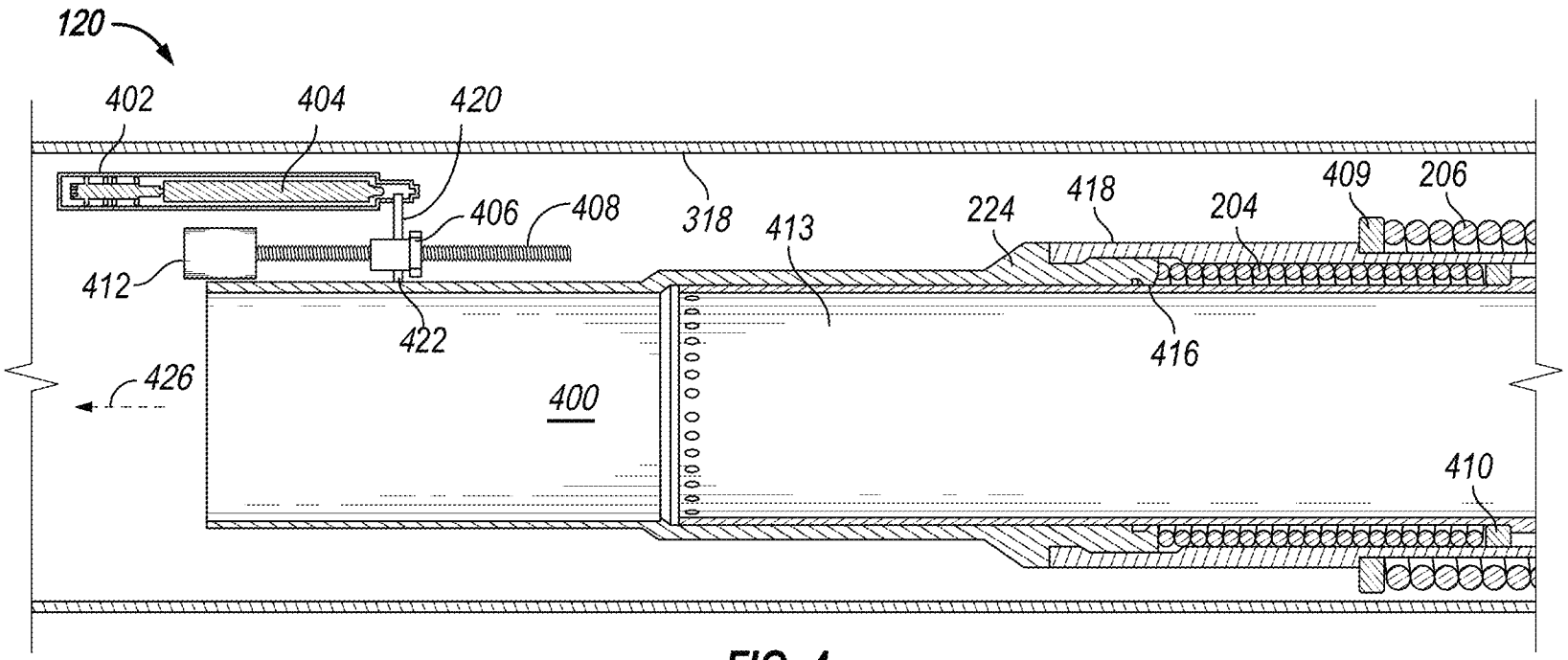
FIG. 4 is a schematic of a sliding assembly being used within a safety valve, in accordance with some embodiments of the present disclosure.

Accordingly, FIG. 4 is a schematic of a sliding assembly 400 being used within a safety valve 120, in accordance with some embodiments of the present disclosure. Sliding assembly 400 may be disposed within body 318 of safety valve 120, such as part of an actuator section 200 (e.g., referring to FIG. 2). Safety valve 120 may comprise any suitable type of safety valve, but in this example comprises tubing retrievable safety valve that includes a flow tube 413, a nose spring 204, and a power spring 206. An arrow at 426 indicates the up-hole direction that production fluids of a producing formation may flow when the safety valve 120 is open. Sliding assembly 400 comprises a hydraulic piston 404 disposed within a piston housing 402, a ball nut 406 that travels axially along a ball screw 408, and an electric brake 412 that may comprise, e.g., an electromagnet and a target (analogous to what is shown above in FIG. 3, to be discussed in greater detail in FIGS. 7A, 7B). This design addresses the problems that may be associated with only using an electromagnet structure 300 (e.g., referring to FIG. 300). It should be understood that while these Figures show sliding assembly 400 comprising a hydraulic piston 404 attached to a ball nut 406 attached to slidable member 224, these three components may be rearranged and fixedly attached in any order. For example, hydraulic piston 404 may be attached to slidable member 224 which may in turn be attached to ball nut 406, to use a non-limiting example.

Piston housing 402 houses a hydraulic piston 404. Actuation of hydraulic piston 404 with a hydraulic pressure of a hydraulic flowline 417 induces hydraulic piston 404 to extend out from piston housing 402 by a distance (e.g., distance 426 of FIG. 4). Hydraulic piston 404 may be fixedly attached to a ball nut 406 which is in turn fixedly attached to slidable member 224. Actuation of hydraulic piston 404 may thus move ball nut 406 axially along ball screw 408 to thereby induce the desired axial movement of slidable member 224, e.g., along a central axis of safety valve 120. A hydraulic flowline 417 may use high pressure below a downhole valve (e.g., flapper valve 214 of FIG. 2) to actuate hydraulic piston 404, such as via one or more internal conduits (not shown) that allow for fluid communication between a region below the valve and the hydraulic piston 404. Alternatively, hydraulic pressure may be supplied in any standard fashion, such as with a hydraulic line that is run from the surface.

Ball nut 406 may be concentrically disposed about a ball screw 408. Ball nut 406 may comprise an inner surface with corresponding threads that match the dimensions of ball screw 408 to allow for rotation of the ball screw 408. In examples, ball nut 406 may be fixedly attached to slidable member 224, e.g., at a tubular surface 222, or in any suitable fashion. Mechanical coupling may be achieved in any suitable fashion, such as with welding, screws, etc. In any embodiment, linear movement of ball nut 406 along ball screw 408 may induce parallel movement of slidable member 224, and vice versa. The purpose of ball nut 406 is to allow hydraulic piston 404 to energetically communicate with electric brake 412 by converting the linear movement to rotation via ball screw 408.

Ball screw 408 may freely rotate relative to ball nut 406. Ball screw 408 is threaded such that when ball nut 406 is moved axially by hydraulic piston 404, the axial movement causes ball screw 408 to rotate. Ball screw 408 is energetically and/or mechanically coupled to electric brake 412 such that energizing electric brake 412 resists or prevents reversal of the linear movement induced by re-expansion of the compressed power spring 206.

Hydraulic piston 404 comprises a single, or multiple, pistons that are hydraulically powered by a supply of pressurized hydraulic fluid. In this example, hydraulic piston 404 is fixedly attached to a ball nut 406 so that hydraulic actuation induces linear movement of both hydraulic piston 404 and ball nut 406 together. A connection 420 may be any suitable mechanical or other connection such as welding, screws, or the like. Other connections may be likewise disposed at one or more locations within body 318 to fixedly secure one or more components of a sliding assembly 400 relative to body 318 or slidable member 224. Hydraulic piston 404 and ball nut 406 may unitarily form a single continuous member, for example. Alternatively, rather than being mechanically coupled directly to ball nut 406, hydraulic piston 404 may be instead configured to push and/or pull on ball nut 406 or a piece fixedly attached thereto, for example.

Linear actuation of ball nut 406 along ball screw 408 may thus induce rotation of ball screw 408. Counter-rotation of ball screw 408 is controlled by an electric brake 412 that is in electric communication with a power source via an electric line 216. A power source may be disposed at the surface 114 (e.g., referring to FIG. 1) or at a downhole location to supply power to electric brake 412 to generate magnetic flux needed to hold safety valve 120 open (e.g., magnetic flux 710 of FIGS. 7A, 7B).

Electric brake 412 is mechanically or otherwise energetically coupled to ball screw 408. When electric brake is powered, it may resist or halt the rotation of ball screw 408 (e.g., by forcing teeth 712 of FIGS. 7A, 7B or 8A, 8B and therefore lock rotation) and thus control or prevent linear movement of ball nut 406 and thus prevent reverse sliding of slidable member 224. (Prong 720 may be fixedly connected to, or in mechanical communication with, e.g., "coupled to," or unitarily formed as part of, ball screw 208). Electric brake 412 turns ON when power is applied to it and turns OFF when power is removed. Applying power energizes a coil, which may cause a magnet body (e.g., magnet structure 702 of FIGS. 8A, 8B) to attract an armature (e.g., armature 706 of FIGS. 8A, 8B), to be discussed later (e.g., referring to FIGS. 8A, 8B). In some examples, an electric brake 412 may be configured with a compression spring (e.g., compression spring 802 of FIGS. 8A, 8B) that upon removal of power, may cause the armature to disengage from the magnet body. This may allow sliding assembly 400 to hold slidable member 224 in a specific position that allows production fluids to flow uphole through the safety valve 120. Electric brake 412 may be configured with a gear box, to be discussed in a later figure (e.g., gear box 600 of FIG. 6). Various designs of electric brakes are available, such as the example shown in FIGS. 7A, 7B, however in general, electric brake 412 may be configured to produce a magnetic flux that resists or prevents, a change in position of a magnet relative to a target. As it applies to this figure, this change in position may be used to resist reversal of the linear movement induced by hydraulic piston 404. Moreover, while only a single electric brake is shown, multiple electric brakes may be used, as well as multiple ball screws, ball nuts, gear boxes, etc., which may all be part of a single, or multiple, sliding assemblies, in some examples.

To prevent shearing between the various components (e.g., connection 420) of sliding assembly 400, hydraulic actuation of hydraulic piston 404 may induce a rotation of ball screw 408 in a first direction (e.g., clockwise only), whereas electric brake 412 resists rotation in a second direction (e.g., counterclockwise only) opposite from the first direction. Electric brake 412 may thus be configured to oppose an upwards biasing force of power spring 206 of FIG. 4, and this is achieved without the need to resist rotation of the ball screw during initial actuation of hydraulic piston 404 from the non-extended (FIG. 5A) to extended (FIG. 5B) position.

Flow tube 413 and slidable member 224 are coupled together (e.g., by nose spring 204, only) which may allow slidable member 224 to translate relative to a flow tube 413 if nose spring 204 compresses or relaxes. This may result in the linear movement induced by actuation of hydraulic piston 404 to also cause linear movement of slidable member 224 along a central axis of safety valve 120. In the present example, flow tube 413 is partially disposed within slidable member 224 but may alternatively be disposed within flow tube 413 so that the linear movement induced by hydraulic actuation causes slidable member 224 to slide with flow tube 413. In the figure shown, part of slidable member 224 is shown concentrically disposed about flow tube 413 so that a force applied by hydraulic piston 404 is applied to nose spring 204 via a shoulder 416 of slidable member 224. In addition, force applied by hydraulic piston 404 may be applied to power spring 206 via shoulder 409 via an additional concentric member 418 disposed, e.g., between slidable member 224 and shoulder 409. During opening of safety valve 120, hydraulic pressure of a hydraulic piston 404 may oppose or counteract a spring force of nose spring 204 and/or power spring 206.

Power spring 206 is seated against respective shoulder 409 to provide an outward biasing force thereto so that when, for example, power is cut to electric brake 412, slidable member 224 is forced back to a closed position so that flow of production fluid is stopped. In some examples, safety valve 120 is configured to change between a first closed position, a second closed position, and an open position, which may involve sliding a conduit (e.g., flow tube 413) to open a valve, such as a flapper valve (e.g., valve 214 of FIG. 2).

Sliding assembly 400 and other components of safety valve 120, e.g., flow tube 413, power spring 206, and nose spring 204, slidable member 224, etc., may be housed by body 318 of safety valve 120. In alternative examples, sliding assembly 400 may be housed in a separate compartment or module disposed, for example, within body 318. In another alternative embodiment, sliding assembly 400 may be alternatively configured so that slidable member 224 is translated axially upwards, such as by positioning a spring (e.g., power spring 206 and nose spring 204 of FIG. 4) uphole from the sliding assembly 400 instead of downhole as shown by FIG. 4.

Figure 5B:
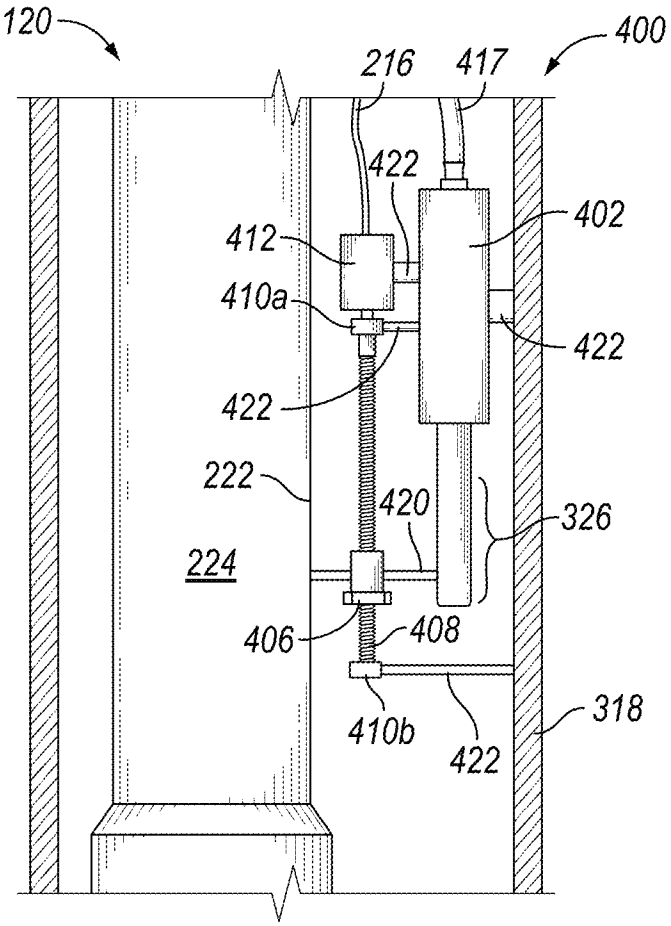
FIG. 5B is a schematic of the sliding assembly of FIG. 5A, but in an extended position, in accordance with some embodiments of the present disclosure.
Figure 5A:
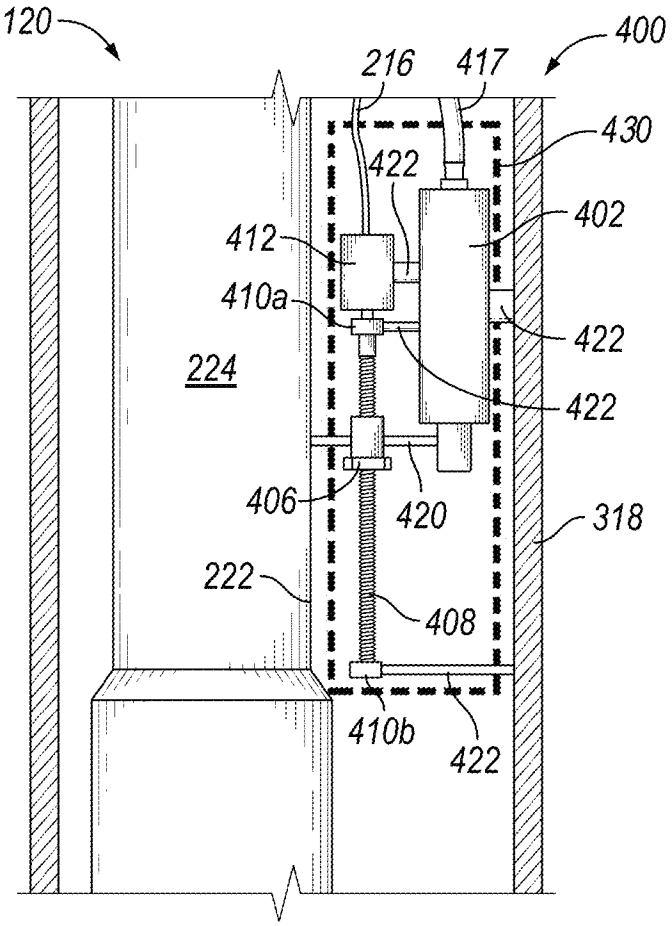
FIG. 5A is a schematic of sliding assembly in a non-extended position, in accordance with some embodiments of the present disclosure.

FIG. 5A is a schematic of sliding assembly 400 in a non-extended position, in accordance with some embodiments of the present disclosure. A sliding assembly 400 may include a piston housing 402 and hydraulic piston 404, ball nut 406, and ball screw 408. In some examples, a safety valve 120 that includes a sliding assembly 400 may be characterized as "hybrid" in that it may be both electrically and hydraulically actuated. Sliding assembly 400 is configured to induce linear movement to a slidable member 224 with hydraulic piston 404 axially, e.g., along an axis of safety valve 120. An electric brake 412 controls or resists reversal of the linear movement to maintain the slidable member 224 in a locked position while the electric brake 412 is powered.

Piston housing 402 houses a hydraulic piston 404. Actuation of hydraulic piston 404 with a hydraulic pressure of a hydraulic flowline 417 may cause hydraulic piston 404 to extend out from piston housing 402 by a distance (e.g., distance 426 of FIG. 4). Hydraulic piston 404 may be fixedly attached to a ball nut which is in turn fixedly attached to slidable member 224. Actuation of hydraulic piston 404 may thus move ball nut 406 axially along ball screw 408 to thereby induce the desired axial movement of slidable member 224. As discussed, hydraulic flowline 417 uses high pressure below a downhole valve (e.g., flapper valve 214 of FIG. 2) to actuate hydraulic piston 404, such as via one or more internal conduits (not shown) that allow for fluid communication between a region below the valve and the hydraulic piston 404. Alternatively, hydraulic pressure may be supplied via hydraulic flowline 417 in any standard fashion.

Ball screw 408 may extend, for example, between a pair of ends 410*a*, 410*b* which may allow for free rotation of ball screw 408. Ends 410*a*, 410*b* may be, for example, metal housing or other compatible structure that provides a structure within which ball screw 408 freely rotates and may be disposed on either side of ball screw 408. Ball screw 408 is threaded such that when ball nut 406 is moved axially by hydraulic piston 404, the axial movement causes ball screw 408 to rotate. Ball screw 408 is energetically and/or mechanically coupled to electric brake 412 such that energizing electric brake 412 resists or prevents reversal of the linear movement that would be induced by the power spring if not for electric brake 412.

Hydraulic piston 404 comprises a single, or multiple, pistons that are hydraulically powered by a supply of pressurized hydraulic fluid of flowline 417. In this example, hydraulic piston 404 is fixedly attached to a ball nut 406 so that hydraulic actuation induces linear movement of both hydraulic piston 404 and ball nut 406 together. A connection 420 may be any suitable mechanical or other connection such as welding, screws, or the like. Other connections 422 may be likewise disposed at one or more locations within body 318 to fixedly secure one or more components of a sliding assembly 400 relative to body 318 or slidable member 224. Hydraulic piston 404 and ball nut 406 may unitarily form a single continuous member, for example. Alternatively, hydraulic piston 404 may be configured to push and/or pull on ball nut 406 or a piece fixedly attached thereto, for example.

Ball nut 406 may be concentrically disposed about a ball screw 408. Ball nut 406 may comprise an inner surface with corresponding threads that match the dimensions of ball screw 408 to allow for sliding engagement between these. In examples, ball nut 406 may be fixedly attached to slidable member 224, e.g., at a tubular surface 222, or in any suitable fashion. In any embodiment, linear movement of ball nut 406 along ball screw 408 may induce parallel movement of slidable member 224, and vice versa. The purpose of ball nut 406 is to allow hydraulic piston 404 to energetically communicate with electric brake 412 by converting the linear movement to rotation via ball screw 408.

Linear actuation of ball nut 406 along ball screw 408 may thus induce rotation of ball screw 408 between, for example, two ends 410*a*, 410*b*. Counter-rotation of ball screw 408 is controlled by an electric brake 412 that is in electric communication with a power source via an electric line 216. A power source may be disposed at the surface 114 (e.g., referring to FIG. 1) or at a downhole location to supply power to electric brake 412 to generate magnetic flux needed to hold safety valve 120 open (e.g., magnetic flux 710 of FIGS. 7A, 7B).

Figure 6:
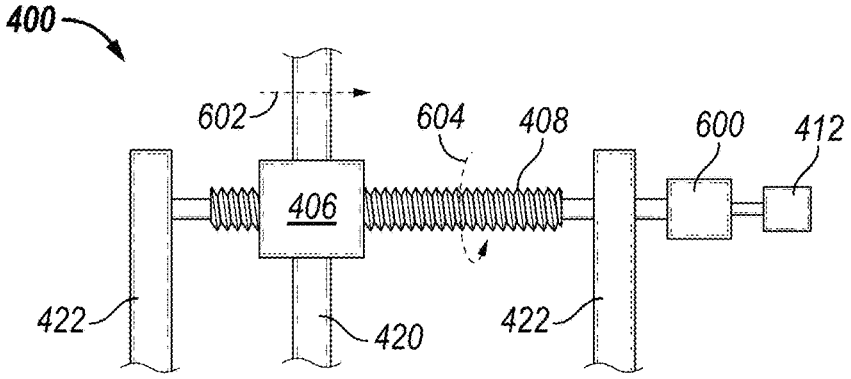
FIG. 6 is a schematic of a sliding assembly like the one shown in FIGS. 5A, 5B, but with a gear box disposed between an electric brake and a ball screw, in accordance with some embodiments of the present disclosure.
Figure 7A:
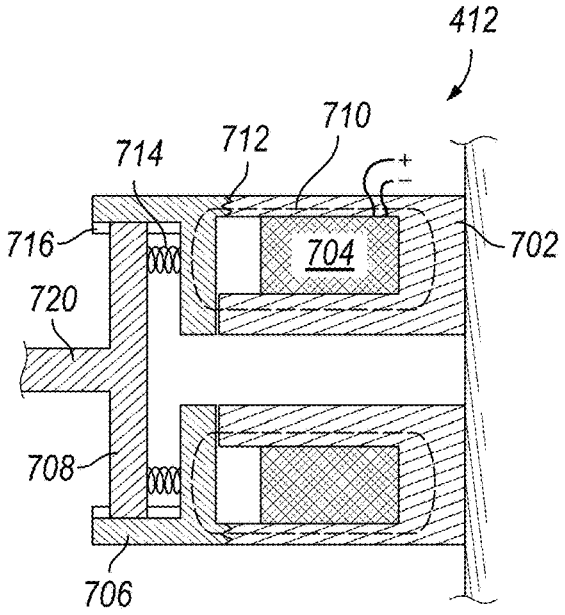
FIG. 7A is a schematic of an electric brake in a locked configuration, in accordance with some embodiments of the present disclosure.
Figure 7B:
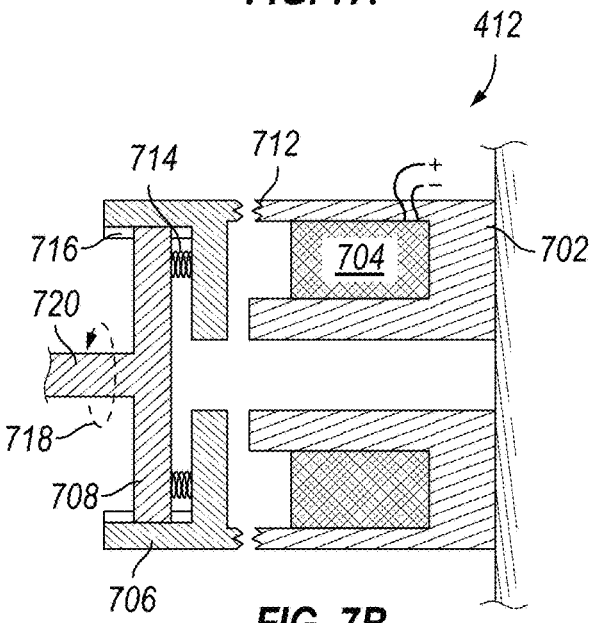
FIG. 7B shows the electric brake of FIG. 7A but in an unpowered and unlocked position with teeth of armature disengaged from those of a magnet structure.

Electric brake 412 is mechanically or otherwise energetically coupled to ball screw 408 via a prong (e.g., prong 720 of FIGS. 7A, 7B). When electric brake 412 is powered, it may resist or halt the rotation of ball screw 408 (e.g., by forcing teeth 712 of FIGS. 7A, 7B and therefore lock rotation) and thus control or prevent linear movement of ball nut 406 and thus prevent reverse sliding of slidable member 224. This may allow sliding assembly 400 to hold slidable member 224 in a specific position that allows production fluids to flow uphole through the safety valve 120. Electric brake 412 may be configured with a gear box, to be discussed in a later figure (e.g., gear box 600 of FIG. 6). Various designs of electric brakes are available, such as the example shown in FIGS. 7A, 7B, however in general, electric brake 412 may be configured to produce a magnetic flux that induces a change in position. As it applies to this figure, this change in position may be used to resist reversal of the linear movement induced by hydraulic piston 404, for example. Moreover, while only a single electric brake is shown, multiple electric brakes may be used, as well as multiple ball screws, ball nuts, etc., which may all be part of a single sliding assembly, in some examples.

To prevent shearing between the various components (e.g., connection 420) of sliding assembly 400, hydraulic actuation of hydraulic piston 404 may induce a rotation in a first direction (e.g., clockwise only), whereas electric brake 412 resists rotation in a second direction (e.g., counterclockwise only) opposite from the first direction. Electric brake 412 may thus be configured to apply counter torque in a first direction that opposes an upwards biasing force (e.g., of a nose spring 204 or power spring 206 of FIG. 4) without counteracting the rotation induced during initial actuation of hydraulic piston 404.

FIG. 5B is a schematic of the sliding assembly 400 of FIG. 5A, but in an extended position, in accordance with some embodiments of the present disclosure. As illustrated, slidable member 224 is translated axially downwards by a distance 426 relative to the sliding assembly 400 of FIG. 5A. Translation of slidable member 224 by distance 426 may open or be concurrent with the opening of one or more fluid conduits or otherwise allow fluid communication of production fluids between a lower region 228 and an upper region 230 across safety valve 120. Electric brake 412 engages ball screw 408 to maintain the ball nut 406 and thus slidable member 224 in the extended open position to enable fluid flow through safety valve 120 as long as electric brake 412 is powered.

As illustrated, hydraulic piston 404 is extended out from piston housing 402 by distance 426. Ball nut 406 is also axially translated downwards by the distance 426. Ball screw 408 is also rotated relative to FIG. 5A. Electric brake 412 and piston housing 402 are in the same position as in FIG. 5A, as are ends 410, 410*b*. Thus, hydraulic actuation of hydraulic piston 404 with hydraulic flowline 412 may induce linear movement of not only hydraulic piston 404 but also ball nut 406 and slidable member 224 together as a single body or structure. This may be achieved without inducing any linear movement to the electric brake 412, piston housing 402, or ball screw 408 along a central axis of safety valve 120, e.g., by virtue of connections 422.

Hydraulic piston 404 is extended out from piston housing by distance 326. Ball nut 406 is axially lowered by the actuation distance, as is slidable member 224. Even as hydraulic pressure supplied to hydraulic piston 404 is bled off, electric brake 412 may hold slidable member 224 in the actuated position to keep safety valve 120 in the open position.

In some examples, piston housing 402 may be directly or indirectly attached to a body 318 of safety valve 120. Mechanical coupling between one or more components of sliding assembly 400 may result in the non-moving parts to be unaffected by the linear movement of the moving parts.

In some examples, ball screw 408 and ball nut 406 may be contained in a clean fluid and isolated from production fluids. This may prevent debris from clogging sliding assembly 400. A clean fluid may comprise, for example, hydraulic fluids, atmospheric air, vacuum, or the like. Electric brake 412 may similarly be isolated from production fluids. Clean fluid may be under pressure, pressurized, or pressure compensated to match a wellbore environment. This may help prevent unwanted fluids from encroaching into sliding assembly 400. Pressure compensation may be achieved, for example, by disposing one or more (e.g., hydraulic piston 404, piston housing 402, ball nut 406, ball screw 408, electric brake 412, and any combination thereof) the various components (and/or their associated connections, e.g., connections 420, 422) of a sliding assembly 400 within a pressure sealed housing (not shown), and monitoring and controlling fluid pressure within such a housing based on at least one pressure outside the housing (e.g., wellbore pressure, pressure from another region or subregion of safety valve 120, pressure from either side of a flapper valve, etc.). Pressure compensation and equalization may be achieved using a rubber diaphragm or metal bellows, for example. Where used, a rubber diaphragm or metal bellows may be placed within a body 318 of safety valve 120, for example. A dotted rectangular box schematically shown in FIG. 5A may represent, e.g., a housing 430 containing one or more (e.g., all) components of sliding assembly 400, and which may contain a clean fluid to isolate sliding assembly 400 or a portion thereof from the production fluids. Where used, housing 430 may be in communication with or otherwise coupled to suitable devices for achieving pressure compensation and equalization.

An example sequence of operations may be performed as follows. When an electric brake 412 is switched off, hydraulic pressure is applied to hydraulic piston 404. Hydraulic pressure may originate from either a surface location or from wellbore pressure below a flapper valve of a safety valve (e.g., valve 214 of FIG. 2). The hydraulic pressure may thus compress one or more springs (e.g., power spring 206 and nose spring 204 of FIG. 4). The electric brake 412 is then energized to lock a brake (e.g., prong 720 of FIG. 7A) in place, creating a locked position. If pressure from below the flapper is used to actuate hydraulic piston 404, then pressure from surface would be applied to equalize the pressure across the flapper. This allows the nose spring to relax and open the flapper while power spring 206 remains compressed because the electric brake 412 is on. If power is lost, the electric brake 412 switches off and the power spring pushes the safety valve 120 back to the closed position. The sequence of operations may be repeated again and again.

FIG. 6 is a schematic of a sliding assembly 400 like the one shown in FIGS. 5A, 5B, but with a gear box 600 disposed between an electric brake 412 and a ball screw 408, in accordance with some embodiments of the present disclosure. Linear movement of ball nut 406 along ball screw 408 is shown by an arrow indicated at 602. Similarly, rotation of ball screw 408 is shown by an arrow indicated at 604. This figure also shows one or more connections 422 fixedly attached to sliding assembly 400, e.g., at either end of ball screw 408, to prevent axial movement of one or more components of sliding assembly 400 during movement of ball nut 406 along ball screw 408.

Gear box 600 may be disposed between ball screw 408 and electric brake 412. A gear box 600 may have any suitable reduction ratio to reduce the power consumption for electric brake 412, for example, between 1.01:1 and 1000:1, or any ranges therebetween. A connection 420 (e.g., mechanical communication) between ball nut 406 and hydraulic piston 404 may cause ball nut 406 to axially move along ball screw 408 upon actuation of hydraulic piston 404 so that ball screw 408 rotates. This opens safety valve 120 (e.g., referring to FIG. 1) and allows production fluid to flow. Sliding assembly 400 is then maintained in the open position using electric brake 412 by supplying electric current thereto, which prevents backwards rotation of ball screw 408 and thus reversion of ball nut 406 to the non-extended position (e.g., FIG. 5A), as discussed. Gear box 600 is configured with a pre-determined reduction ratio chosen to ensure electric brake 412 functions reliably.

FIG. 7A is a schematic of an electric brake 412 in a locked position, in accordance with some embodiments of the present disclosure. As shown, electric brake 412 may comprise a magnet structure 702 and a coil 704, magnet structure 702 having teeth 712 seated against corresponding teeth of armature 706 that houses an output plate 708, wherein splines 716 and release springs 614 mediate extension and retraction of output plate 708. A magnetic flux 710 may hold armature against body when electric brake 412 is energized. Thus, magnetic flux 710 may account for maintaining a safety valve 120 (e.g., referring to FIGS. 4, 5A, and 5B) in an open position.

FIG. 7B shows the electric brake 412 of FIG. 7A but in an unpowered and in an unlocked position with teeth 712 of armature 706 disengaged from those of magnet structure 702. Release springs 714 are biased compressed against output plate 708 and a rotation 718 of output plate 708 is indicated at 718 along splines 716. As mentioned, the electric brake 412 shown in FIGS. 7A and 7B is but one example of an electric brake 412.

Figure 8A:
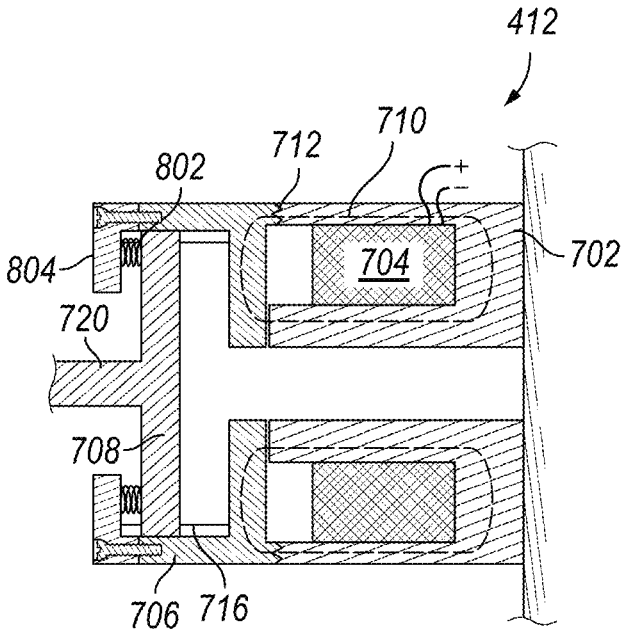
FIG. 8A is a schematic of an electric brake having a compression spring, showing a locked configuration, in accordance with some embodiments of the present disclosure.

FIG. 8A is a schematic of an electric brake having a compression spring, showing a locked configuration, in accordance with some embodiments of the present disclosure. As shown, electric brake 412 may comprise a magnet structure 702 and a coil 704, magnet structure 702 having teeth 712 seated against corresponding teeth of armature 706 that houses an output plate 708, wherein splines 716 and compression springs 802 mediate extension and retraction of output plate 708. A magnetic flux 710 may attract armature 706 against magnet structure 702 when electric brake 412 is energized, thereby inducing compression of compression spring 802 against its relaxed, uncompressed state. Here, de-energizing of electric brake 412 allows compression spring 802 to exert an outward force between output plate 708 and an overhanging region 804 of armature 706 away from magnet structure 702 so that compression spring 802 returns to its relaxed, uncompressed state. Thus, magnetic flux 710 may account for maintaining a safety valve 120 (e.g., referring to FIGS. 4, 5A, and 5B) in an open position.

Figure 8B:
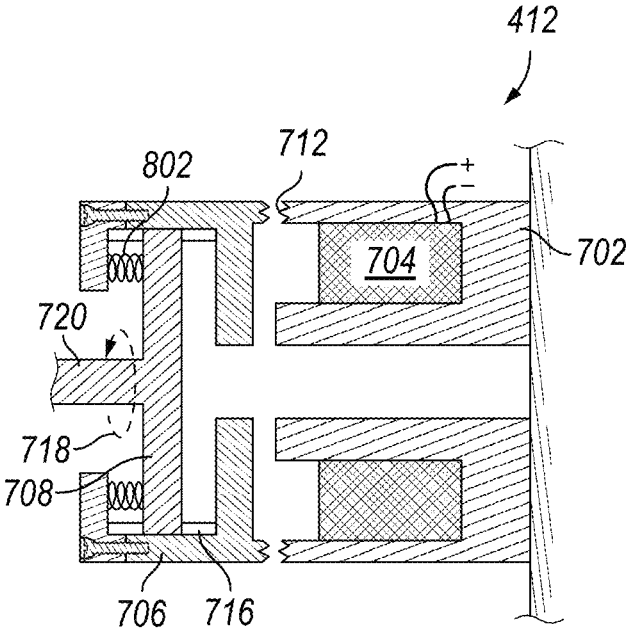
FIG. 8B shows the electric brake of FIG. 8A but in an unpowered and unlocked position with teeth of armature disengaged from those of a magnet structure.

FIG. 8B shows the electric brake of FIG. 8A but in an unpowered and unlocked position with teeth 712 of armature 706 disengaged from those of a magnet structure 702. As shown, compression springs 802 are shown in their relaxed and/or preloaded state. Rotation 718 of output plate 708 and its prong 720 is indicated at 718 along splines 716. As mentioned, the electric brake 412 shown in FIGS. 8A and 8B is but one example of an electric brake 412.

Figure 9A:
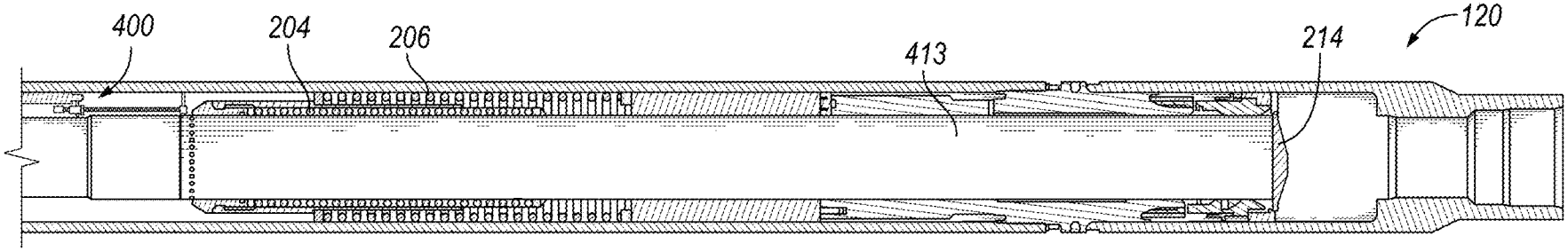
FIG. 9A is an example of a safety valve, as shown in FIG. 2, but in a first closed position, with nose spring and power spring uncompressed, in accordance with some embodiments of the present disclosure.
Figure 9B:
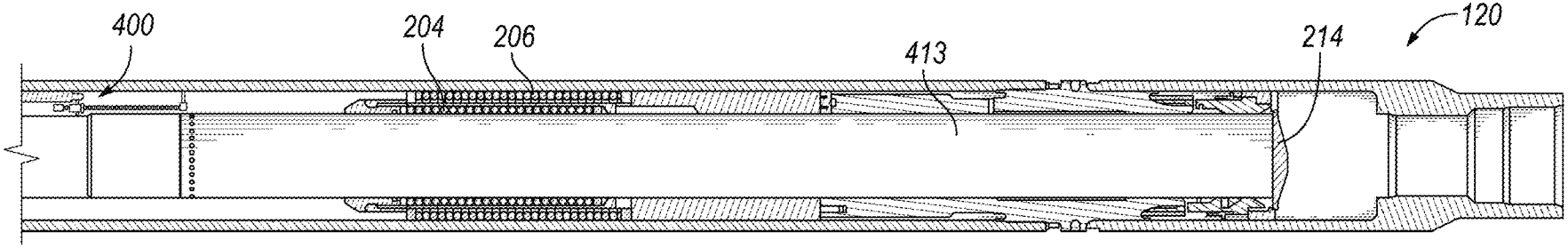
FIG. 9B shows the safety valve of FIG. 9A, but in a second closed position, with nose spring and power spring compressed, in accordance with some embodiments of the present disclosure.
Figure 9C:
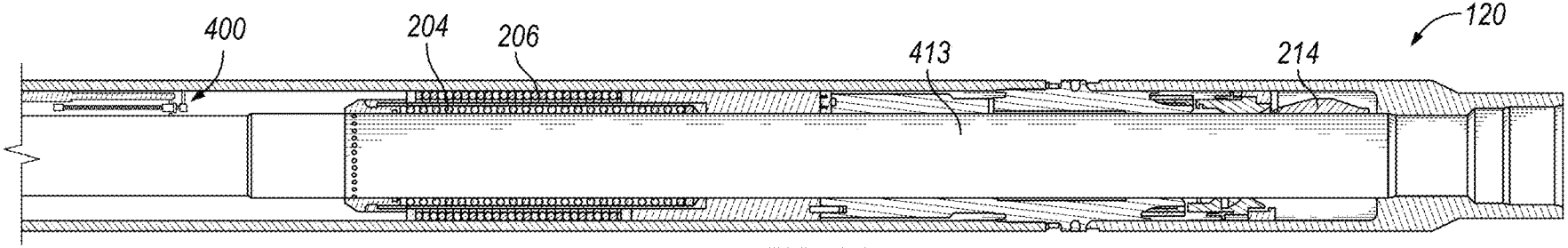
FIG. 9C shows the safety valve of FIGS. 9A and 9B, but in an open position, with power spring compressed, nose spring uncompressed, and flow tube pushed through a flapper valve, in accordance with some embodiments of the present disclosure.

FIG. 9A is an example of a safety valve 120, as shown in FIG. 2, but in a first closed position, with nose spring 204 and power spring 206 uncompressed, in accordance with some embodiments of the present disclosure. Here, flapper valve 214 is closed. A sliding assembly 400 is shown in a non-extended configuration at a region uphole from the nose and power springs 204, 206. FIG. 9B shows the safety valve 120 of FIG. 9A, but in a second closed position, with nose spring 204 and power spring 206 compressed, in accordance with some embodiments of the present disclosure. Here, flapper valve 214 is likewise closed, and sliding assembly 400 is in the non-extended configuration. FIG. 9C shows the safety valve 120 of FIGS. 9A and 9B, but in an open position, with power spring 206 compressed, nose spring 204 uncompressed, and flow tube 413 pushed through a flapper valve 214, in accordance with some embodiments of the present disclosure. Here, flapper valve 214 is open, and the sliding assembly 400 is n an extended configuration with, e.g., a hydraulic piston extended out from a housing.

In operation, pressure is applied by wellbore fluid above the safety valve 120, thereby compressing both power spring 206 and nose spring 204 (Transition of FIG. 9A to 9B). Eventually, the pressure allows valve 214 to open (FIG. 9C)

and for flow tube 413 to translate downwards. The electric brake 412 of the sliding assembly 400 is actuated to hold open the safety valve 120 in the open position (FIG. 9C). In this state, production fluid from a production zone in the wellbore may travel upwards through the open safety valve until the electric brake 412 of the sliding assembly is de-energized and the power spring 206 forces the flow tube 413 to retract and thereby causes the safety valve 120 to return to either of the previous closed positions (e.g., FIGS. 9A or 9B, depending on the pressure difference above and below safety valve 120).

A process control system may be utilized to monitor and control production of formation fluids from a well where the safety valve is disposed. A process control system may include components such as flowmeters, pressure transducers, pumps, power systems, and associated controls system for each. The process control system may provide power or cut off power to an electric brake 412 (e.g., referring to any of FIGS. 4-6) and may be in electronic communication with an information handling system 130 (e.g., referring to FIG. 1). An electromagnet structure may be designed to run off any power source such as alternating current ("A/C") or direct current ("D/C"). The process control system may allow an operator to open the electrically actuated safety valve by the methods described above, e.g., by using hydraulic pressure to actuate a piston, powering an electromagnet structure, and the like. Wellbore fluid pressures and flow rates may be monitored by the process control system to ensure safe operating conditions and that the production process does not exceed safety limitations. Should a process upset occur such as an overpressure event, the process control system may detect the process upset and automatically cut power to an electric brake 412. As discussed above, cutting power to an electric brake may cause the safety valve to automatically close thereby containing pressures and fluids.

Advantages of the sliding assembly/ies, safety valve(s), or downhole tools of the present disclosure may include, without limiting to any particular embodiment, a reduction in the need for excessive hydraulically powered components compared to traditional hydraulics-only systems. Namely, the use of a hybrid system that uses both a hydraulic piston to open the safety valve and an electric brake to counteract closure of the safety valve may resolve problems associated with using only an electromagnet structure or only a hydraulic piston. Moreover, the sliding assembly may have reduced susceptibility to loss of holding capacity resulting from buildup of debris and scale.

Accordingly, the present disclosure may provide systems, apparatuses, and methods for fail safe closure of a downhole safety tool. The methods, systems, and tools may include any of the various features disclosed herein, including one or more of the following statements.

Statement 1: A sliding assembly, comprising: a hydraulic piston; a ball nut affixed to the hydraulic piston; a ball screw disposed through the ball nut; and an electric brake affixed to the ball screw.

Statement 2: The sliding assembly of statement 1, wherein the electric brake affixed to the ball screw via a gear box.

Statement 3: The sliding assembly of statement 2, wherein the electric brake is in: a locked position; or an unlocked position.

Statement 4: The sliding assembly of statement 3 wherein linear movement of the hydraulic piston causes rotation of the ball screw.

Statement 5: The sliding assembly of statement 4, wherein when the electric brake is in the locked position, the electric brake resists rotation of the ball screw.

Statement 6: The sliding assembly of statement 4, wherein when the electric brake is in the locked position, the electric brake resists the linear movement of a flow tube in mechanical communication with the sliding assembly.

Statement 7: The sliding assembly of statement 4, wherein when the electric brake is in the unlocked position, the electric brake does not resist rotation of the ball screw.

Statement 8: The sliding assembly of statement 4, wherein when the electric brake is in the unlocked position, the electric brake does not resist the linear movement of the flow tube caused by expansion of a power spring.

Statement 9: The sliding assembly of any of statements 1-8, wherein the electric brake is an electromagnetic brake comprising a coil housed within a magnet body, the magnet body interlocking with an armature via teeth, and an output plate connected along splines to the armature.

Statement 10: The sliding assembly of statement 9, wherein a spring forces the magnet body to disengage from the armature when power to the electric brake is cut off.

Statement 11: A method comprising: supplying hydraulic pressure to a sliding assembly to open a safety valve, wherein the sliding assembly comprises: a hydraulic piston; a ball nut affixed to the hydraulic piston; a ball screw disposed through the ball nut; and an electric brake affixed to the ball screw; and delivering power to the electric brake to resist movement of the ball nut along the ball screw to maintain the safety valve in an open position.

Statement 12: The method of statement 11, wherein the electric brake affixed to the ball screw via a gear box.

Statement 13: The method of statement 12, wherein the electric brake is in: a locked position; or an unlocked position.

Statement 14: The method of statement 13, wherein linear movement of the hydraulic piston causes rotation of the ball screw.

Statement 15: The method of statement 14, wherein when the electric brake is in the locked position, the electric brake resists rotation of the ball screw.

Statement 16: The method of statement 14, wherein when the electric brake is in the locked position, the electric brake resists linear movement of a flow tube in mechanical communication with the sliding assembly.

Statement 17: The method of statement 14, wherein when the electric brake is in the unlocked position, the electric brake does not resist rotation of the ball screw caused by expansion of a power spring.

Statement 18: The method of statement 14, wherein when the electric brake is in the unlocked position, the electric brake does not resist the linear movement of a flow tube caused by expansion of a power spring.

Statement 19: The method of any of statements 11-18, wherein the electric brake is an electromagnetic brake comprising a coil housed within a magnet structure, the magnet structure interlocking with an armature via teeth, and an output plate connected along splines to the armature.

Statement 20: The method of statement 19, wherein a spring forces the magnet body to disengage from the armature when power to the electric brake is cut off.

Statement 21: A sliding assembly, comprising: a hydraulic piston attached to a ball nut and configured to induce linear movement of the ball nut along a ball screw; the ball nut concentrically disposed about a ball screw and configured to transfer the linear movement to a flow tube in mechanical communication with the sliding assembly while turning the ball screw; and an electric brake configured to resist rotation of the ball screw and thus resist reversal of the linear movement.

Statement 22: The sliding assembly of statement 21, wherein the linear movement opens fluid communication between regions above and below a safety valve to thereby allow upwards flow of production fluid therethrough while the electric brake is powered.

Statement 23: The sliding assembly of statements 21 or 22, wherein at least the ball nut and the ball screw are contained within a clean fluid isolated from a wellbore environment.

Statement 24: The sliding assembly of statement 23, wherein the clean fluid is pressure compensated relative to a wellbore environment.

Statement 25: The sliding assembly of statement 24, wherein the pressure compensation is achieved with a rubber diaphragm or metal bellows.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure. It is also to be understood that the terminology used herein is for the purpose of describing particular embodiments only and is not intended to be limiting. As used herein, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected. If there is any conflict in the usages of a word or term in this specification and one or more patent or other documents that may be incorporated herein by reference, the definitions that are consistent with this specification should be adopted for the purposes of understanding this invention.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

The scope of the present disclosure includes any feature or combination of features disclosed herein (either explicitly or implicitly), or any generalization thereof, whether or not it mitigates any or all of the problems addressed herein. Various advantages of the present disclosure have been described herein, but embodiments may provide some, all, or none of such advantages, or may provide other advantages.

What is claimed is:

1. A sliding assembly, comprising:
- a hydraulic piston;
- a ball nut affixed to the hydraulic piston;
- a ball screw disposed through the ball nut; and
- an electric brake, wherein the electric brake is affixed to the ball screw via a gear box, wherein the gear box provides a reduction ratio that reduces the power consumption required to actuate the electric brake and is configured to engage and disengage from the electric brake via an armature, and wherein the electric brake comprises:
  - a magnet structure; and
  - a spring, wherein the spring is configured to disengage the armature from the magnet structure when power to the electric brake is cut off.

2. The sliding assembly of claim 1, wherein the electric brake is in:
- a locked position; or
- an unlocked position.

3. The sliding assembly of claim 2 wherein linear movement of the hydraulic piston causes rotation of the ball screw.

4. The sliding assembly of claim 3, wherein when the electric brake is in the locked position, the electric brake resists rotation of the ball screw.

5. The sliding assembly of claim 3, wherein when the electric brake is in the locked position, the electric brake resists the linear movement of a flow tube in mechanical communication with the sliding assembly.

6. The sliding assembly of claim 3, wherein when the electric brake is in the unlocked position, the electric brake does not resist rotation of the ball screw.

7. The sliding assembly of claim 3, wherein when the electric brake is in the unlocked position, the electric brake does not resist the linear movement of a flow tube caused by expansion of a power spring.

8. The sliding assembly of claim 1, wherein the electric brake is an electromagnetic brake further comprising a coil housed within the magnet structure, wherein the magnet structure interlocks with the armature via teeth, and wherein an output plate is connected along splines to the armature.

9. A method comprising:
- supplying hydraulic pressure to a sliding assembly to open a safety valve, wherein the sliding assembly comprises:
  - a hydraulic piston;
  - a ball nut affixed to the hydraulic piston;
  - a ball screw disposed through the ball nut;
  - an electric brake affixed to the ball screw via a gear box configured to engage and disengage from the electric brake via an armature, wherein the gear box provides a reduction ratio to reduce the power consumption required to actuate the electric brake; and
  - wherein the electric brake comprises:
    - a magnet structure; and
    - a spring configured to disengage the armature from the magnet structure when power to the electric brake is cut off; and
- delivering power to the electric brake to resist movement of the ball nut along the ball screw to maintain the safety valve in an open position.

10. The method of claim 9, wherein the electric brake is in:

a locked position; or an unlocked position.

11. The method of claim 10, wherein linear movement of the hydraulic piston causes rotation of the ball screw.

12. The method of claim 11, wherein when the electric brake is in the locked position, the electric brake resists rotation of the ball screw.

13. The method of claim 11, wherein when the electric brake is in the locked position, the electric brake resists linear movement of a flow tube in mechanical communication with the sliding assembly.

14. The method of claim 11, wherein when the electric brake is in the unlocked position, the electric brake does not resist rotation of the ball screw caused by expansion of a power spring.

15. The method of claim 11, wherein when the electric brake is in the unlocked position, the electric brake does not resist the linear movement of a flow tube caused by expansion of a power spring.

16. The method of claim 9, wherein the electric brake is an electromagnetic brake further comprising a coil housed within the magnet structure, the magnet structure interlocking with the armature via teeth, and an output plate connected along splines to the armature.

17. A sliding assembly, comprising:

a hydraulic piston attached to a ball nut and configured to induce linear movement of the ball nut along a ball screw;

the ball nut concentrically disposed about a ball screw and configured to transfer the linear movement to a flow tube in mechanical communication with the sliding assembly while turning the ball screw; and an electric brake configured to resist rotation of the ball screw and thus resist reversal of the linear movement, wherein the electric brake is affixed to the ball screw via a gear box, wherein the gear box provides a reduction ratio that reduces the power consumption required to actuate the electric brake and is configured to engage and disengage from the electric brake via an armature, and wherein the electric brake comprises:

a magnet structure; and a spring, wherein the spring is configured to disengage the armature from the magnet structure when power to the electric brake is cut off;

wherein at least the ball nut and the ball screw are contained within a clean fluid isolated from a wellbore environment.

* * * * *